US007434634B1

(12) United States Patent
Hall et al.

(10) Patent No.: US 7,434,634 B1
(45) Date of Patent: Oct. 14, 2008

(54) DOWNHOLE TURBINE

(76) Inventors: David R. Hall, 2185 S. Larsen Pkwy., Provo, UT (US) 84606; Daryl Wise, 2185 S. Larsen Pkwy., Provo, UT (US) 84606; David Lundgreen, 2185 S. Larsen Pkwy., Provo, UT (US) 84606; Nathan Nelson, 2185 S. Larsen Pkwy., Provo, UT (US) 84606; Scott Dahlgren, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/940,117

(22) Filed: Nov. 14, 2007

Related U.S. Application Data

(63) Continuation of application No. 11/940,091, filed on Nov. 14, 2007.

(51) Int. Cl.
*E21B 4/02* (2006.01)

(52) U.S. Cl. ..... 175/107; 166/65.1

(58) Field of Classification Search ..... 175/107; 166/65.1

See application file for complete search history.

(56) References Cited

U.S. PATENT DOCUMENTS

| | | | | | |
|---|---|---|---|---|---|
| 2,940,039 | A * | 6/1960 | Yost et al. | ..... | 324/174 |
| 3,187,191 | A | 6/1965 | Baggs | | |
| 3,936,683 | A | 2/1976 | Walker | | |
| 4,207,485 | A | 6/1980 | Silver | | |
| 4,277,707 | A | 7/1981 | Silver | | |
| 4,283,779 | A * | 8/1981 | Lamel | ..... | 367/82 |
| 4,722,661 | A | 2/1988 | Mizuno | | |
| 4,732,225 | A | 3/1988 | Jurgens | | |
| 4,754,181 | A | 6/1988 | Mizobuchi | | |
| 4,802,150 | A | 1/1989 | Russell | | |
| 5,090,944 | A | 2/1992 | Kyo | | |
| 5,270,600 | A | 12/1993 | Hashimoto | | |
| 5,762,156 | A | 6/1998 | Bates | | |
| 5,839,508 | A * | 11/1998 | Tubel et al. | ..... | 166/65.1 |
| 6,011,334 | A | 1/2000 | Roland | | |
| 6,388,346 | B1 | 5/2002 | Lopatinsky | | |
| 6,672,409 | B1 | 1/2004 | Dock | | |
| 6,863,124 | B2 | 3/2005 | Araux | | |
| 7,133,325 | B2 * | 11/2006 | Kotsonis et al. | ..... | 367/83 |

* cited by examiner

*Primary Examiner*—Hoang Dang
(74) *Attorney, Agent, or Firm*—Tyson J. Wilde

(57) ABSTRACT

In one aspect, a downhole assembly has a downhole tool string component with a bore adapted to accommodate drilling mud. A fluid barrier is disposed within the bore and has a cylindrical portion substantially aligned with the bore. A drive shaft is sealed within and substantially coaxial with the cylindrical portion and has a first magnet disposed on its outer surface. A turbine assembly is disposed around the cylindrical portion of the fluid barrier and has an inner diameter and outer surface. The outer surface of the turbine assembly has a plurality of turbine blades. The inner diameter of the turbine assembly has a second magnet disposed within a region defined by the turbine blades and is in magnetic communication with the first magnet of the drive shaft, wherein when the drilling mud engages the turbine blades the first and second magnets rotate the drive shaft with the turbine assembly.

18 Claims, 8 Drawing Sheets

DOWNHOLE TURBINE

CROSS REFERENCE TO RELATED APPLICATIONS

This application is a continuation of U.S. patent application Ser. No. 11/940,091, which was filed on Nov. 14, 2007 and entitled "Downhole Turbine." U.S. patent application Ser. No. 11/940,091 is herein incorporated by reference for all that it teaches.

BACKGROUND OF THE INVENTION

This invention relates to downhole drilling assemblies, specifically downhole drilling assemblies for use in oil, gas, geothermal, and horizontal drilling. The ability to efficiently provide a power source downhole is desirable to electronically and mechanically power downhole instrumentation.

U.S. Pat. No. 4,802,150 to Russell et al., which is herein incorporated by reference for all that it contains, discloses a downhole signal generator for a mud-pulse telemetry system that comprises a flow constrictor defining a throttle orifice for the mud passing along a drill string, a throttling member displaceable with respect to the throttle orifice to modulate the mud pressure for the purpose of transmitting measurement data up the drill string, and a turbogenerator. The turbogenerator incorporates an annular impeller surrounding a casing and arranged to be driven by the mud passing along the drill string, and a rotatable magnet assembly disposed in a mud-free environment within the casing. The impeller includes an electrically conductive drive ring and the rotatable magnet assembly includes rare earth magnets, so that, when the impeller is rotated by the mud flow, eddy currents are induced in the drive ring by the magnetic field associated with the magnets and the magnet assembly is caused to rotate with the impeller by virtue of the interaction between the magnetic field associated with the induced currents. In this manner torque may be imparted to an electrical generator within the casing without a rotating seal having to be provided between the impeller and the generator.

U.S. Pat. No. 6,011,334 to Roland, which is herein incorporated by reference for all that it contains, discloses an electric power generator driven by a fluid circulating under pressure in a pipe includes an internal moving contact placed inside a non-magnetic section of the pipe, and a stator placed around the pipe. The internal moving contact includes permanent magnets, a rotational drive means, and means of support. The electric power generator does not require any sealed joints for the passage of mechanical shafts or electric cables and is particularly adapted for the production of electricity from dangerous fluids which circulate in pipes under high pressure. The electric power generator has an application in gas and liquid transport networks, particularly at isolated hydrocarbon production sites.

BRIEF SUMMARY OF THE INVENTION

In one aspect of the present invention, a downhole assembly has a downhole tool string component with a bore adapted to accommodate drilling mud. A fluid barrier is disposed within the bore and has a cylindrical portion substantially aligned with the bore. A drive shaft is sealed within and substantially coaxial with the cylindrical portion and has a first magnet disposed on its outer surface. A turbine assembly is disposed around the cylindrical portion of the fluid barrier and has an inner diameter and outer surface. The outer surface of the turbine assembly has a plurality of turbine blades. The inner diameter of the turbine assembly has a second magnet disposed within a region defined by the turbine blades and is in magnetic communication with the first magnet of the drive shaft, wherein when the drilling mud engages the turbine blades the first and second magnets rotate the drive shaft with the turbine assembly.

The drive shaft may be in communication with at least one generator disposed within the fluid barrier. The drive shaft may be in communication with a first and second generator disposed within the fluid barrier. The first generator may be a 1 kW generator and the second generator may be a 2.5 kW generator.

The downhole string component may convert energy from the drilling mud flow into at least 10 foot-pounds of rotational energy. The drive shaft may be hollow. The drive shaft may comprise a large diameter portion and a small diameter portion. The drive shaft may comprise at least one cap. The drive shaft may be in communication with at least one gear box disposed within the fluid barrier.

The fluid barrier may isolate an oil environment from the drilling mud. The fluid barrier may comprise titanium, Inconel, Inconel 718, materials with a magnetic permeability less than 1.005, or combinations thereof. The fluid barrier may comprise at least one joint.

The at least one gear box may be disposed intermediate the downhole tool string component and the at least one generator. A rotor of the at least one generator may have a rotational speed 1.5 to 8 times faster than the rotational speed of the driveshaft. The drive shaft may be in communication with a jack element protruding beyond the working face of the drill bit. In some embodiments of the present invention, there is no gear set between the magnetic coupling of the turbine to the driveshaft and the generators.

The outer surface of the turbine assembly may be tapered. The plurality of turbine blades may be press-fit to the outer surface of the turbine assembly. The rotational speed of the turbine may stall at an optimal speed required by the at least one generator to work at peak efficiency. The turbine assembly may have any length. In some embodiments, the approximate length may be 17 inches to 29 inches. The first and second magnet may comprise samarium-cobalt.

In another aspect of the present invention a downhole assembly has a downhole tool string component comprising a through bore adapted to pass drilling mud from a first end of the component to a second end of the component. A turbine assembly is disposed within the bore and in communication with a downhole electrical generator through a drive shaft. The generator has a plurality of electrically conducting coils disposed around a rotor with at least one magnetic element, which rotor is connected to the driveshaft. The generator has the characteristic of having a range of rotor rotational velocity to which the generator produces an optimal amount of power and the turbine assembly has an overall characteristic which causes the turbine assembly to stall when engaged by drilling mud at a turbine rotational velocity which causes the rotor to not exceed a maximum rotational velocity of the range.

DETAILED DESCRIPTION OF THE INVENTION AND THE PREFERRED EMBODIMENT

Figure 1:
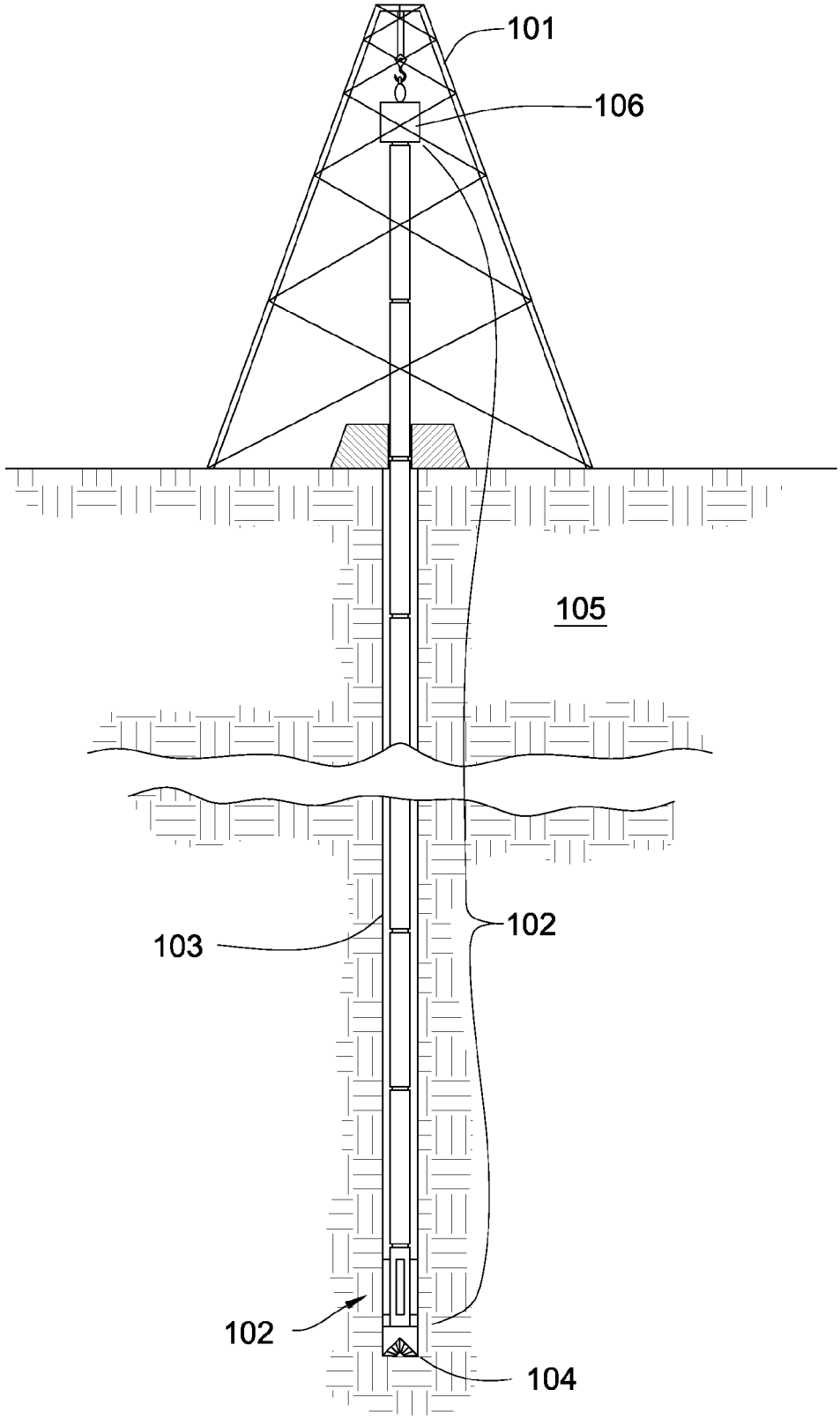
FIG. 1 is a cross-sectional diagram of an embodiment of a drill string suspended in a bore hole.

FIG. 1 is an embodiment of a drill string 100 suspended by a derrick 101. A downhole assembly 102 is located at the bottom of a bore hole 103 and comprises a drill bit 104. As the drill bit 104 rotates downhole the drill string 100 advances farther into the earth. The drill string may penetrate soft or hard subterranean formations 105. The downhole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the downhole assembly 102.

Figure 2:
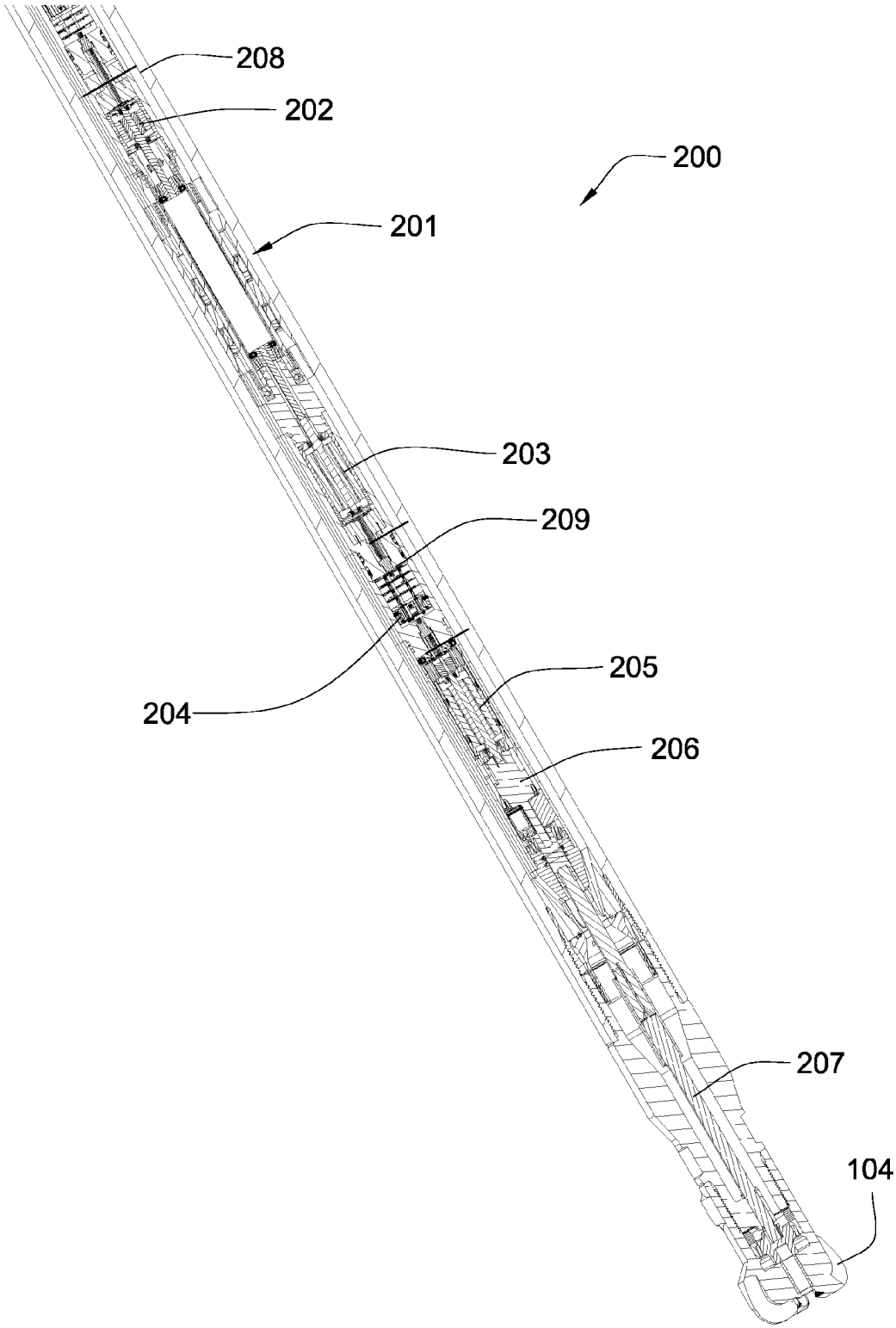
FIG. 2 is a cross-sectional diagram of an embodiment of a downhole tool string component.
Figure 3:
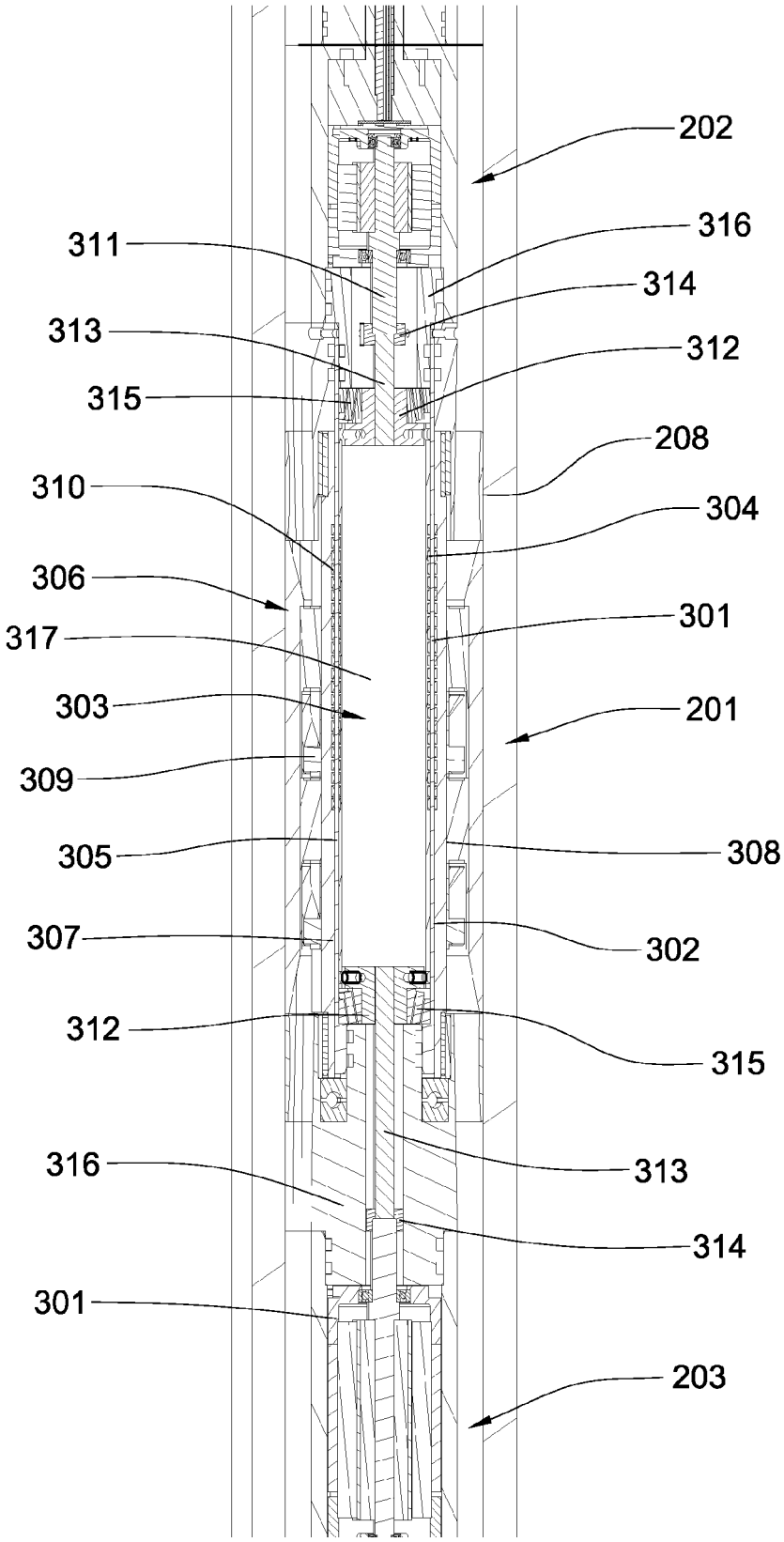
FIG. 3 is a cross-sectional diagram of an embodiment of a portion of the downhole tool string component.

Referring now to FIGS. 2 through 3, the downhole assembly 102 comprises a downhole tool string component 200. A bore 208 is formed in the downhole component 200 to accommodate the flow of drilling mud. A turbine 201 may be disposed within the bore 208 and in communication with a first 202 and second generator 203. The first generator may be a 1 kW generator and the second generator may be a 2.5 kW generator. Electricity is produced as the drilling mud drives the turbine 201 which in turn drives the generators 202, 203.

The electricity may be used to power sensors 209, motor controls 204, batteries, steering systems, and a motor 205. The motor 205 may be in mechanical communication with a jack element 207 protruding beyond a working face of the drill bit that is used to steer the drill string 100. One such jack element 207 is disclosed in U.S. patent application Ser. No. 11/837,321 which is herein incorporated by reference for all that it discloses. A gearbox 206 may be disposed intermediate the motor 205 and the steering jack 207.

A fluid barrier 301 is disposed within the bore 208 and comprises a cylindrical portion 302 substantially aligned with the bore 208. A drive shaft 303 of the turbine 201 is sealed within and substantially coaxial with the cylindrical portion 302 of the fluid barrier. A first magnet 304 is disposed on an outer surface 305 of the drive shaft 303 and may comprise samarium-cobalt.

A turbine assembly 306 is disposed around the cylindrical portion 302 of the fluid barrier 301 and comprises an inner diameter 307 and an outer surface 308. The outer surface 308 of the turbine assembly 306 comprises a plurality of turbine blades 309 and the inner diameter 307 of the turbine assembly 306 comprises a second magnet 310 disposed within a region defined by the turbine blades 309 and is in magnetic communication with the first magnet 304 of the drive shaft 303. The second magnet 310 may also comprise samarium cobalt. In some embodiments of the invention, other magnetic materials may be used. When the drilling mud engages the turbine blades 309 the first and second magnets 304, 310 rotate the drive shaft 303 with the turbine assembly 306. The drive shaft 303 may be in communication with the first 202 and second generator 203 so that the drive shaft 303 rotates rotors 311 of the generators 202, 203. A coupling 314 may be used to couple the drive shaft 303 to the rotors 311. Thus as the drive shaft rotates with the turbine blades from the flowing drilling mud of the tool string since the drive shaft and the turbine assembly are magnetically coupled through the fluid barrier.

The fluid barrier may comprise a material selected from the group consisting of titanium, Inconel 718, or combinations thereof. The fluid barrier 301 may isolate an oil environment from the drilling mud, the oil environment being disposed within the fluid barrier 301 and meant to service mechanical components such as the gear box and generators. The fluid barrier 301 may extend beyond the drive shaft 303 to provide a seal for other downhole components and instruments. The first and second generators 202, 203 may be sealed with in the fluid barrier 301. The fluid barrier 301 may comprise at least one joint 316 disposed intermediate the cylindrical portion 302 and the generators 202, 203 dividing the fluid barrier 301 into multiple parts between the generators 202, 203 and the turbine 201. The joint 316 may connect the multiple parts of the fluid barrier 301 to each other.

One advantage of the present invention is reducing the number of sealed, oil filled environments within the tool string not to mention length and cost reduction of the steering assembly.

Figure 4:
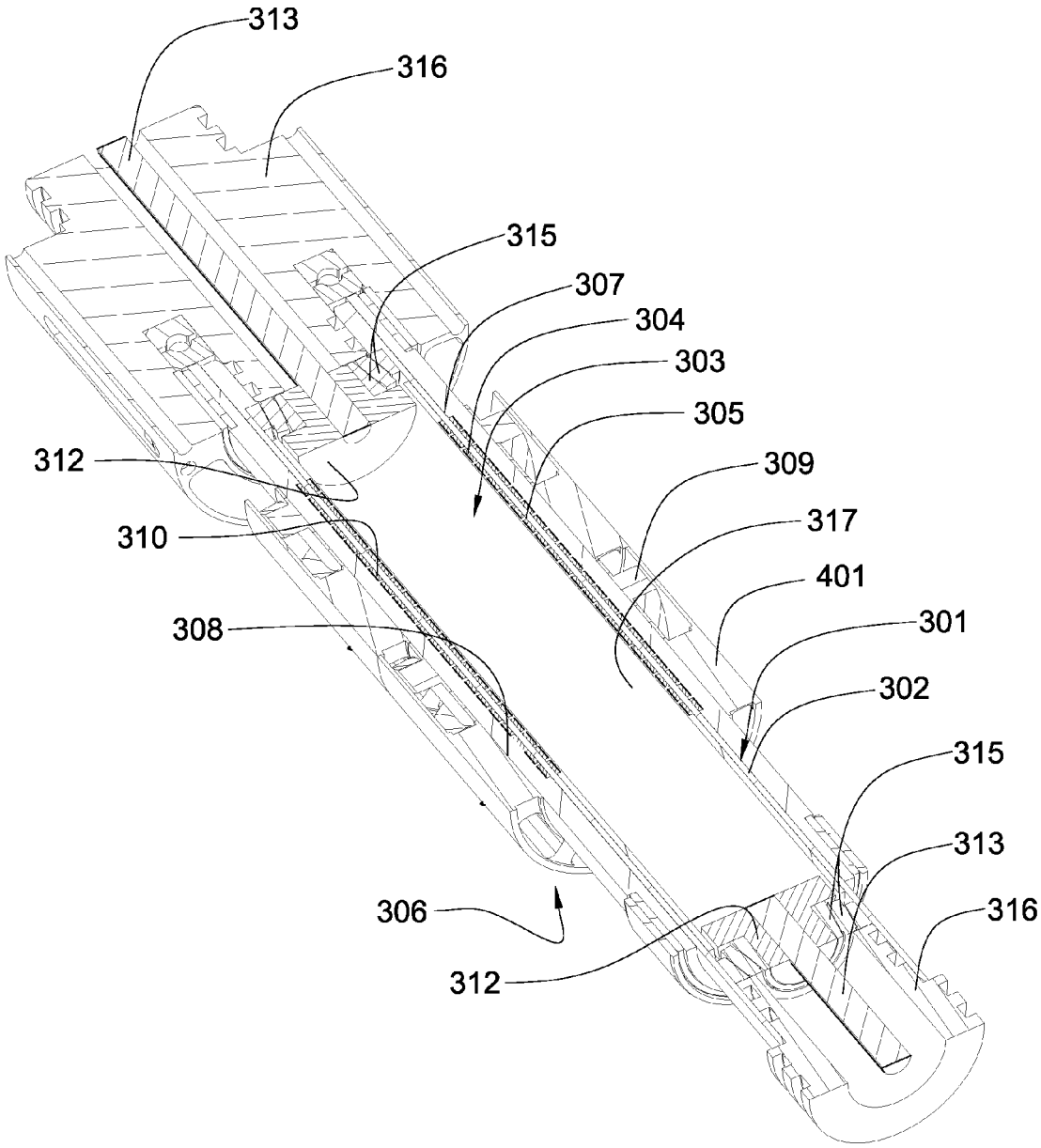
FIG. 4 is a cross-sectional diagram of an embodiment of a turbine.

Referring to FIG. 4, the drive shaft 303 may comprise a large diameter portion 317 and a small diameter portion 313. The large diameter portion 317 may comprise a diameter 2 to 7 times larger than a diameter of the small diameter portion 313. The large diameter portion 317 may be disposed within the cylindrical portion 302 of the fluid barrier 301. At least one cap 312 may be disposed intermediate the large diameter portion 317 and the small diameter portion 313. The cap 312 may be utilized to couple the large diameter portion 317 to the small diameter portion 313.

Bearings 315 may be disposed intermediate the drive shaft 303 and the fluid barrier 301 to facilitate the rotation of the drive shaft 303. More specifically the bearings 315 may be disposed intermediate the fluid barrier 301 and the caps 312. The bearings 315 may comprise radial carbide bearings, PDC-thrust bearings, radial bearings or combinations thereof.

The turbine assembly 306 may have an approximate length of 17 inches to 29 inches. The plurality of turbine blades 309 may be press-fit to the outer surface 308 of the turbine assembly 306. In some embodiments, mechanical locks may be used in combination with the press-fit to keep the turbine assembly from moving with respect to the outer surface. The outer surface 308 of the turbine assembly 306 may be tapered. It is believed that it would be easier to press-fit the turbine blades 309 to the outer surface 308 of the turbine assembly 306 if the outer surface 308 was tapered. The turbine assembly 306 may comprise stators 401 that may be press-fit to the inside of the bore 208. It is believed that the stators 401 may assist the directional flow of drilling mud as it flows across the turbine blades 309 and thus increase the efficiency of the turbine 201.

The downhole string component 200 may convert energy from the drilling mud flow into at least 10 foot-pounds of rotational energy. The rotational speed of the turbine 201 may stall at an optimal speed required by the at least one generator 202, 203 to work at peak efficiency.

Figure 5:
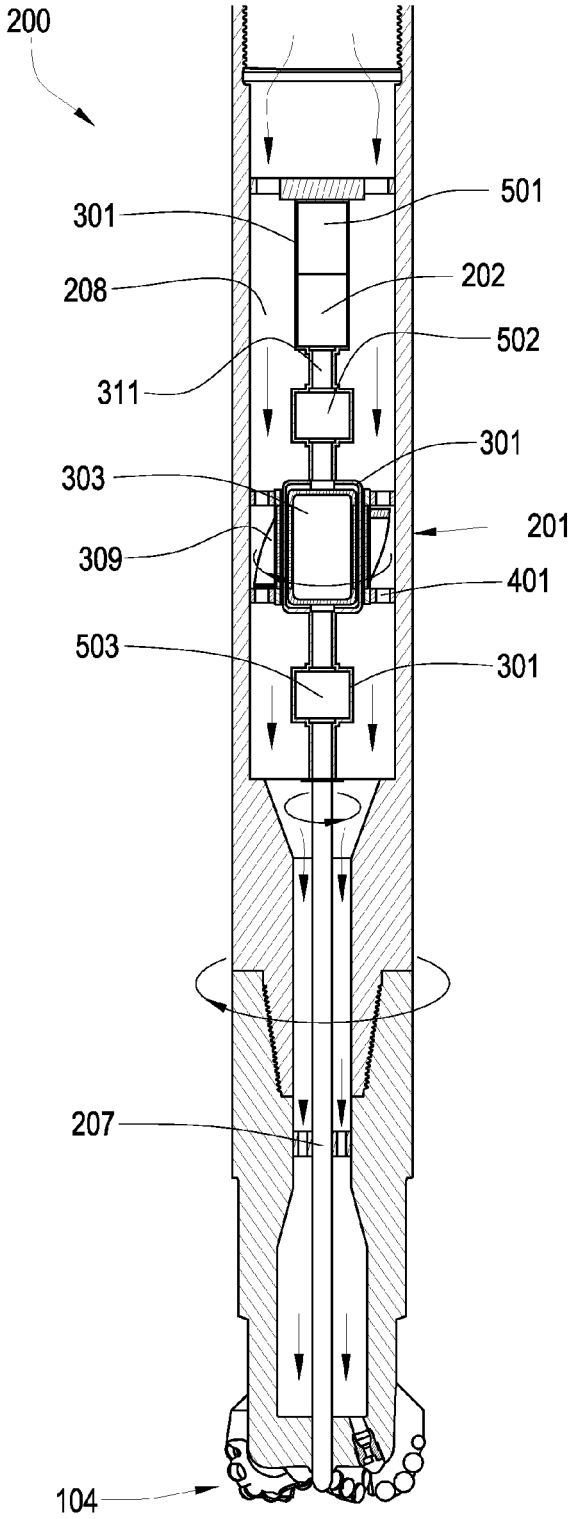
FIG. 5 is a cross-sectional diagram of another embodiment of a portion of the downhole tool string component.

Referring now to FIG. 5, the drive shaft 303 of the turbine 201 may be in communication with at least one gear box 503. The at least one gear box 503 may be disposed intermediate the turbine 201 and the element jack 207 putting the element jack 207 into mechanical communication with the drive shaft. The at least one gear box 503 may be sealed within the fluid barrier.

At another gear box 502 may be disposed intermediate the turbine 201 and the at least one generator 202. This gear box 502 may allow the rotor 311 of the generator 202 to have a rotational speed 1.5 to 8 times faster than the rotational speed of the driveshaft 303. The generator 202 may be in communication with a brake 501. One such brake 501 is disclosed in U.S. patent application Ser. No. 11/611,310 which is herein incorporated by reference for all that it discloses. Gear box 502, the generator 202 and the brake 501 may be sealed within the fluid barrier 301.

Figure 6:
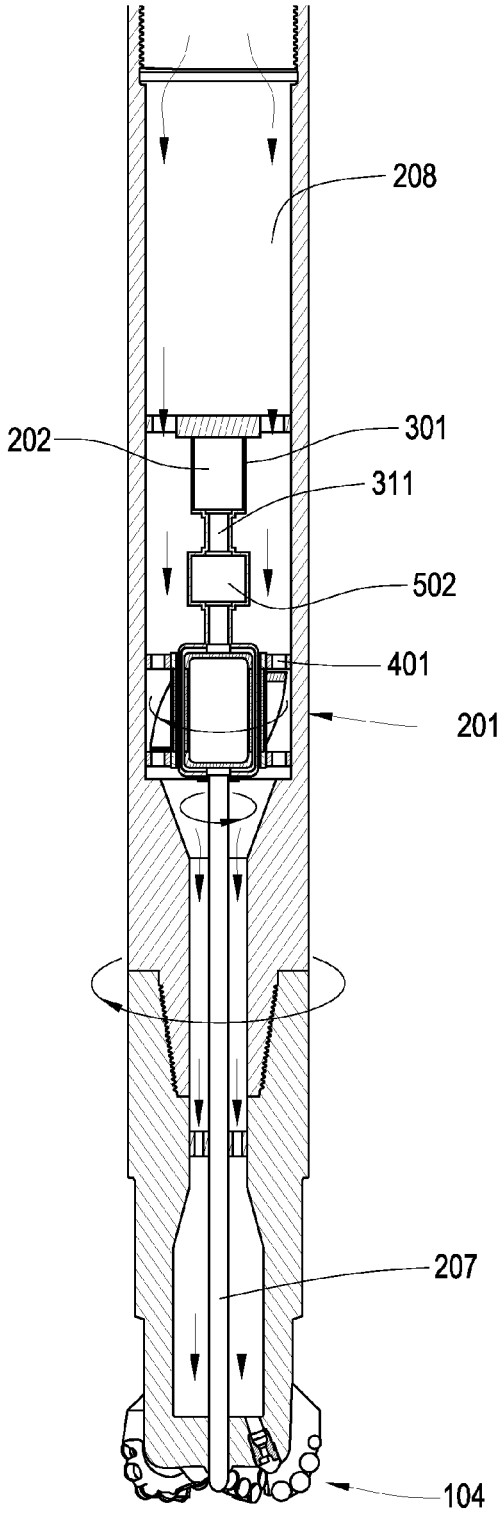
FIG. 6 is a cross-sectional diagram of another embodiment of a portion of the downhole tool string component.
Figure 7:
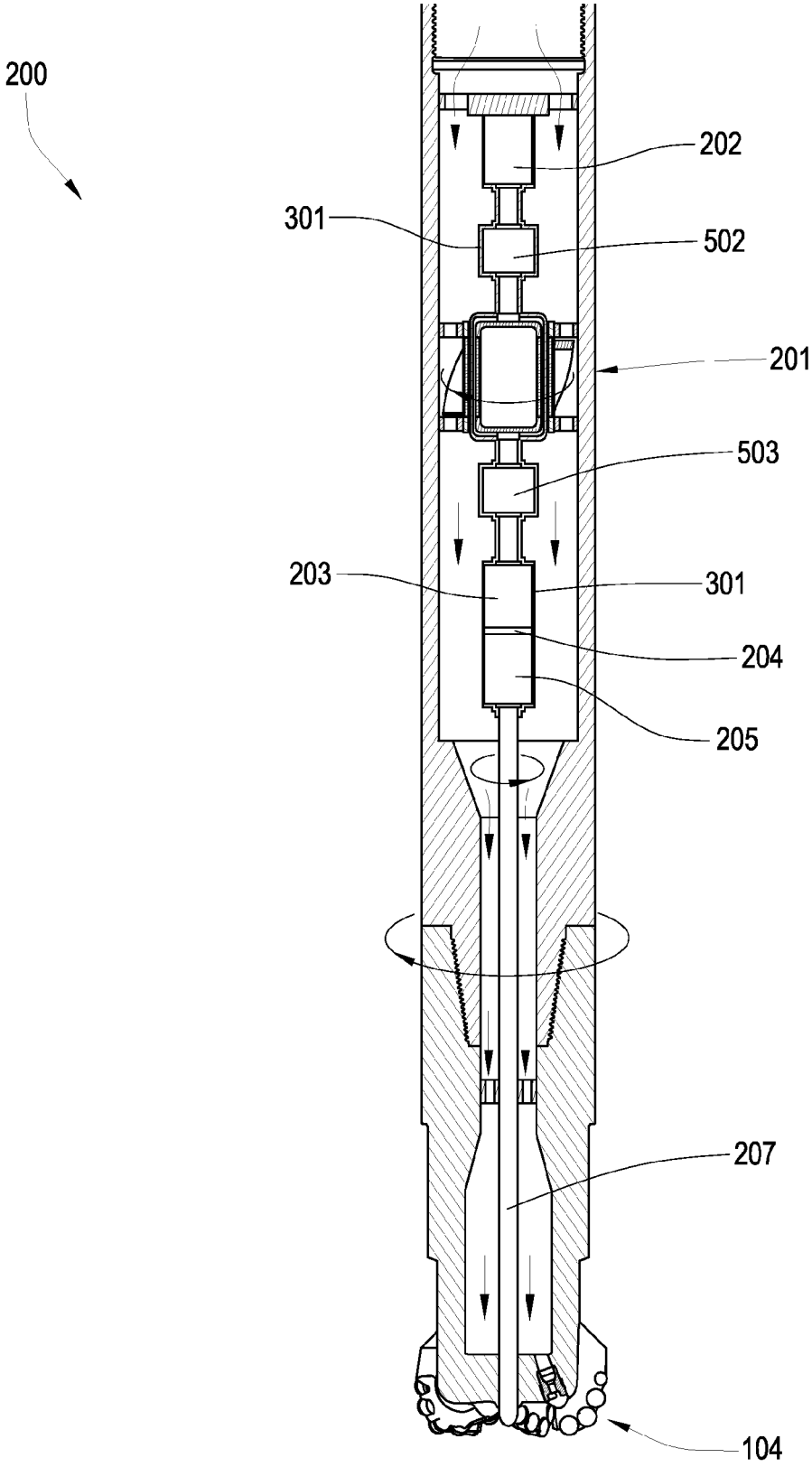
FIG. 7 is a cross-sectional diagram of another embodiment of a portion of the downhole tool string component.

The turbine 201 may be in direct communication with the jack element 207 such as in the embodiment of FIG. 6. As the drilling mud drives the turbine 201 the turbine 201 will rotate the jack element 207. The mud flow rate may be controlled so as to regulate the rotation of the turbine 201 and jack element 207. The motor 205 and motor controls 204 may be sealed within the fluid barrier such as in the embodiment of FIG. 7.

Figure 8:
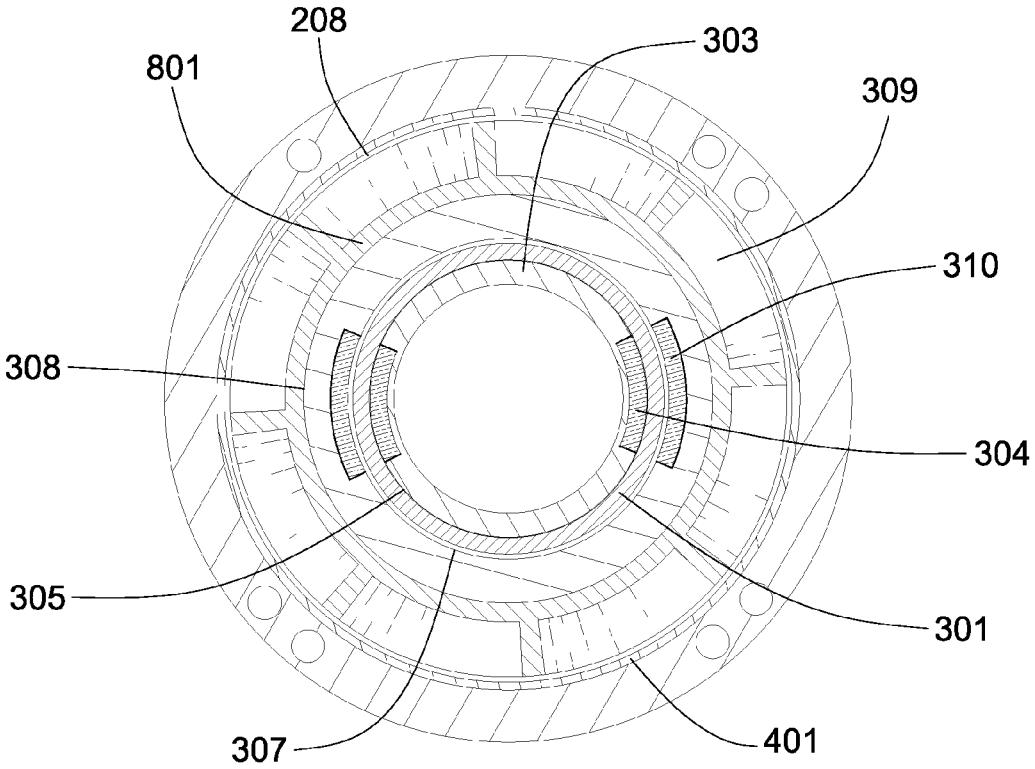
FIG. 8 is a cross-sectional diagram of another embodiment of a turbine.
Figure 9:
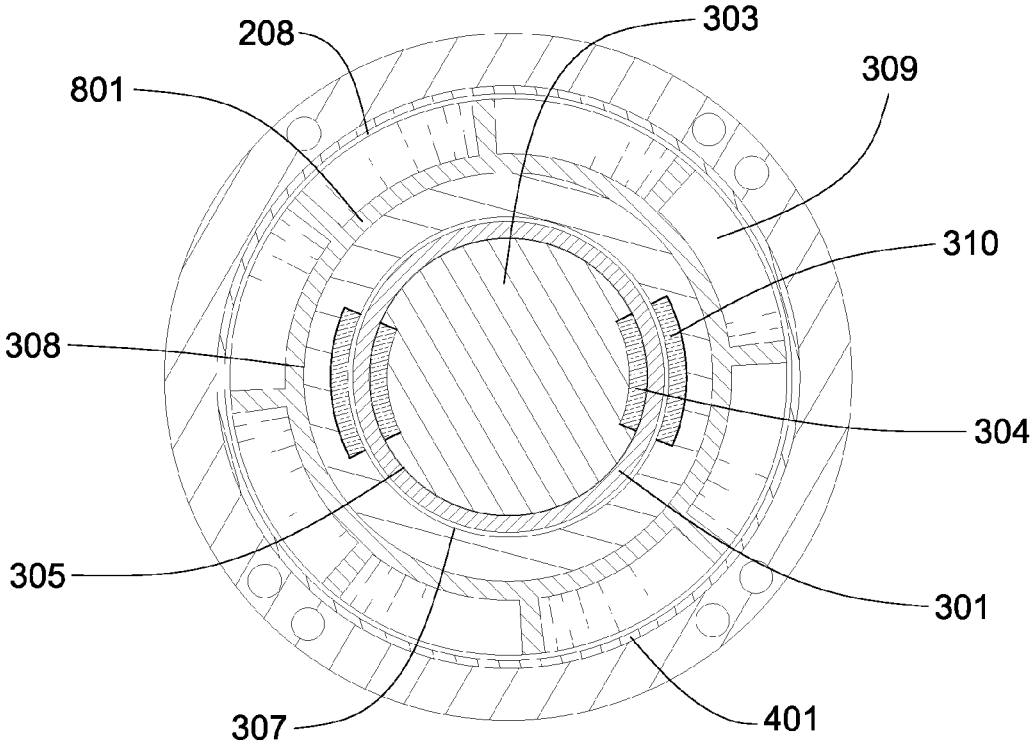
FIG. 9 is a cross-sectional diagram of another embodiment of a turbine.

FIGS. 8 through 9 disclose cross-sectional views of the turbine 201. The driveshaft 303 may be substantially hollow. The driveshaft 303 may be substantially solid and may comprise a uniform diameter. The plurality of turbine blades 309 may be connected to a ring 801. The ring 801 may be press-fit around the outer surface 308 of the turbine assembly 306 connecting the turbine blades 309 to the turbine assembly 306.

Figure 10:
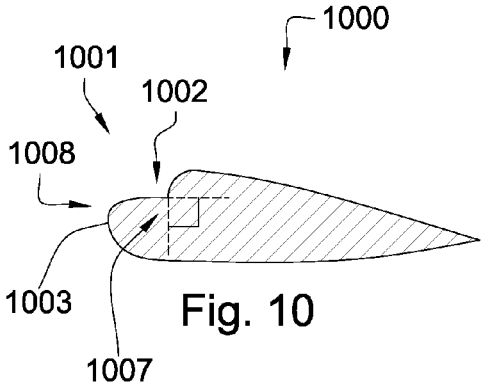
FIG. 10 is a sectional diagram of an embodiment of a turbine blade.

FIG. 10 discloses a section 1000 of a turbine blade which may be used in the present invention. In some embodiment of the invention, the generator has plurality of electrically conducting coils disposed around a rotor with at least one magnetic element, which rotor is attached to the driveshaft. The generator comprises a characteristic of having a range of rotor rotational velocity to which the generator produces an optimal amount of power. The turbine assembly may also comprise an overall characteristic which causes the turbine to stall when the rotor to exceeds a maximum rotational velocity of the range. The blade section 1000 may comprise a trip 1001 which may be adapted to cause the blade to stall at the predetermined velocity. The trip 1001 may comprise a concavity 1002 formed in a leading portion 1008 of the blade section 1000. The concavity 1002 may separate a first and second upper camber 1003, 1004 of the leading portion 1008 of the section. The first and second upper cambers 1003, 1004, may comprise substantially equivalent curvatures. The concavity 1002 may also comprise an acute transition 1007 from the first to the second camber. The acute transition 1007 may form an angle of at least 75 degrees. In some embodiments where the turbine blade is adapted to stall, the turbine assembly may be in mechanical communication with the generator through the driveshaft.

Figure 11:
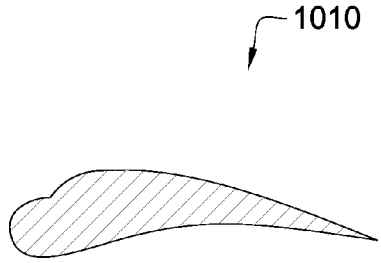
FIG. 11 is a sectional diagram of another embodiment of a turbine blade.

FIG. 11 discloses a spiral blade section 1010 which may also be used with the present invention, also comprises a stalling trip.

Figure 12:
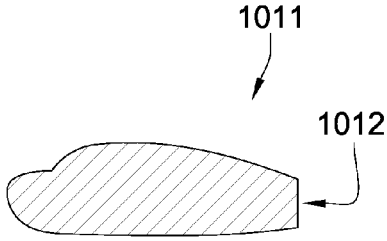
FIG. 12 is a sectional diagram of another embodiment of a turbine blade.

FIG. 12 discloses a straight blade section 1011 which also comprises a truncated trailing portion 1012.

Figure 13:
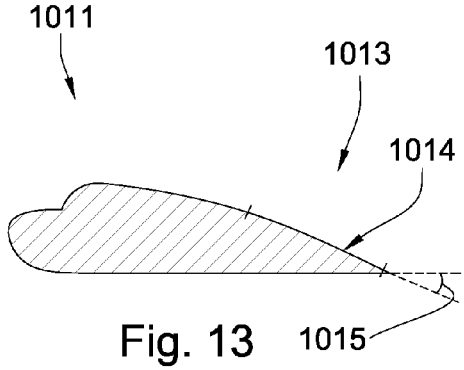
FIG. 13 is a sectional diagram of another embodiment of a turbine blade.

FIG. 13 discloses a blade section 1011 with a trailing portion 1013 comprising a profile segment 1014 that forms an angle 1015 greater than 25 degrees.

Figure 14:
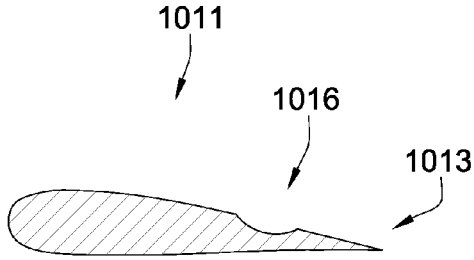
FIG. 14 is a sectional diagram of another embodiment of a turbine blade.

FIG. 14 discloses a blade section 1011 with a trailing portion 1013 also comprising a concavity 1016.

Whereas the present invention has been described in particular relation to the drawings attached hereto, it should be understood that other and further modifications apart from those shown or suggested herein, may be made within the scope and spirit of the present invention.

The invention claimed is:

1. A downhole assembly, comprising:

a downhole tool string component comprising a through bore adapted to pass drilling mud from a first end of the component to a second end of the component;

a turbine assembly being disposed within the bore and in communication with a downhole electrical generator through a drive shaft;

the generator comprises a plurality of electrically conducting coils disposed around a rotor with at least one magnetic element, which rotor is connected to the driveshaft;

the generator comprises a characteristic of having a range of rotor rotational velocity to which the generator produces an optimal amount of power;

the turbine assembly comprises an overall characteristic which causes the turbine assembly to stall when engaged by drilling mud at a turbine rotational velocity which causes the rotor to exceed a maximum rotational velocity of the range.

2. The assembly of claim 1, wherein the turbine assembly comprise a through bore.

3. The assembly of claim 1, wherein the turbine assembly is in mechanical communication with the generator.

4. The assembly of claim 1, wherein the turbine assembly is in magnetic communication with the generator.

5. The assembly of claim 1, wherein at least one turbine blade comprises a fluid trip which is adapted to stall the blade at a predetermined velocity.

6. The assembly of claim 5, wherein the trip comprises a concavity formed in a leading portion of a section of the blade.

7. The assembly of claim 6, wherein the concavity separates a first and second upper camber.

8. The assembly of claim 7, wherein the first and second upper cambers comprise substantially equivalent curvatures.

9. The assembly of claim 7, wherein the concavity comprises an acute transition from the first to the second camber.

10. The assembly of claim 9, wherein the acute transitions forms an angle of at least 75 degrees.

11. The assembly of claim 5, wherein the at least one blade is a spiral or straight blade.

12. The assembly of claim 5, wherein the at least one blade comprises a truncated trailing portion.

13. The assembly of claim 5, wherein a trailing portion of the at least one blade comprises a profile segment that forms an angle greater than 25 degrees.

14. The assembly of claim 5, wherein a trailing portion of the at least one blade comprises a concavity.

15. The assembly of claim 1, wherein a gear box is intermediate the turbine assembly and the generator.

16. The assembly of claim 1, wherein the generator is in electrical communication with a downhole steering systems.

17. The assembly of claim 1, wherein the generator is in electrical communication with a downhole sensor.

18. The assembly of claim 1, wherein the generator is in communication with a downhole electric motor.

* * * * *